US005847688A

United States Patent [19]

Ohi et al.

[11] Patent Number: 5,847,688

[45] **Date of Patent: *Dec. 8, 1998**

[54] LIQUID CRYSTAL DISPLAY APPARATUS HAVING AN INCREASED VIEWING ANGLE

[75] Inventors: Susumu Ohi; Hiroshi Shiba, both of Tokyo, Japan

[73] Assignee: NEC Corporation, Tokyo, Japan

[ * ] Notice: The term of this patent shall not extend beyond the expiration date of Pat. No. 5,604,511.

[21] Appl. No.: 326,222

[22] Filed: Oct. 20, 1994

[30] Foreign Application Priority Data

Oct. 20, 1993 [JP] Japan ..... 5-285998

[51] Int. Cl.[6] ..... G09G 5/04

[52] U.S. Cl. ..... 345/98; 345/88; 348/674

[58] Field of Search ..... 348/674–677; 345/87, 89, 94, 99, 98, 209, 150

[56] References Cited

U.S. PATENT DOCUMENTS

| | | | |
|---|---|---|---|
| 4,653,865 | 3/1987 | Kando et al. . | |
| 5,122,790 | 6/1992 | Yasuda et al. | 345/209 |
| 5,289,270 | 2/1994 | Hayashi | 358/512 |
| 5,404,165 | 4/1995 | Ohtsubo et al. | 348/674 X |
| 5,483,256 | 1/1996 | Ohi | 345/98 |
| 5,489,917 | 2/1996 | Ikezaki et al. . | |
| 5,539,476 | 7/1996 | Sasaki et al. | 348/674 |
| 5,563,725 | 10/1996 | Kumada et al. | 345/150 |
| 5,581,298 | 12/1996 | Sasaki et al. | 348/254 |
| 5,604,511 | 2/1997 | Ohi | 345/98 |

FOREIGN PATENT DOCUMENTS

| | | | |
|---|---|---|---|
| 59-007339 | 1/1984 | Japan | 345/87 |
| 63-39280 | 2/1988 | Japan . | |
| 1216385 | 8/1989 | Japan . | |
| 5-34658 | 2/1993 | Japan | 345/87 |

OTHER PUBLICATIONS

"A Wide–Viewing–Angle 5–in. Diagonal AMLCD Using Halftone Grayscale", by Sarma et al., ISSN0097–0966X/91, SID 91 Digest pp. 555–557.

"41.5: Late–News Paper: A Full–Color TFT–LCD with a Domain–Divided Twisted–Nematic Structure", by Koike et al., ISSN0097–0966X/92 SID 92 Digest pp. 798–801.

"S15–6 A Complementary TN LCD with Wide–Viewing–Angle Grayscale", by Takatori et al., Japan Display '92 pp. 591–594.

"A Wide–Viewing–Angle 10–Inch–Diagonal Full–Color Active–Matrix LCD using a Halftone–Grayscale Method", by Sunata et al., CH–3071–Aug. 1991 pp. 255–256.

"Two–Domain Twisted Nematic and Titled Homeotropic Liquid Crystal Displays for Active Matrix Applications", by Yang CH–3071–Aug. 1991 pp. 68, 71–72.

*Primary Examiner*—Amare Mengistu

*Attorney, Agent, or Firm*—Sughrue, Mion, Zinn, Macpeak & Seas, PLLC

[57] ABSTRACT

In a liquid crystal display apparatus, the gamma characteristics of an image signal is changed each two frames, so that a driving voltage obtained from the changed gamma characteristics is applied to a liquid crystal. A wide viewing field angle can electrically be realized.

13 Claims, 11 Drawing Sheets

VIEWING ANGLE DEPENDENCY OF
VOLTAGE-TRANSMITTANCE CHARACTERISTICS

LIQUID CRYSTAL DISPLAY APPARATUS HAVING AN INCREASED VIEWING ANGLE

BACKGROUND OF THE INVENTION

1. Field of the Invention

The present invention relates to a liquid crystal display apparatus, and more specifically to a liquid crystal display apparatus having an increased viewing angle.

2. Description of Related Art

Demand for the liquid crystal display (abbreviated "LCD" hereinafter) is now increasing because of its compactness and its low power consumption. In addition, various efforts are being made to elevate function and performance of the LCD, for example, to realize a large screen size, high definition and a multiple gradation. At present, an LCD panel having a screen size of about 10 inches in diagonal, resolution of 300,000 to 1,310,000 pixels and a display capability of sixteen grayscale levels (4,096 colors) is manufactured on a pass production basis for office automation instruments. As a trial product, a full color LCD of 64 or more grayscale levels has been already reported.

However, the LCD has a viewing angle smaller than that of a cathode ray tube, and, in particular, the viewing angle is small in an up-down (vertical) direction. This is a problem. A normally white transparent twisted nematic LCD, which is now most used in office automation instruments, is used in such a manner that, by changing a voltage applied across a liquid crystal sandwiched between a pair of polarizing plates having a plane of polarization perpendicular to each other, an oriented condition of the liquid crystal is caused to change. A light linearly polarized by an incident side polarizing plate, is converted into an elliptically polarized light; only a component of the elliptically polarized light, consistent with the plane of polarization in an output side polarizing plate, passes through the output side polarizing plate. As a result, luminance is controlled.

LCDs for the office automation instruments are rubbed on both a thin film transistor (TFT) side surface and a color filter (CF) side surface, in respective directions as shown in FIG. 1A, so that liquid crystal molecules are oriented in the respective directions.

When no voltage is applied, the liquid crystal molecules are oriented in a lying condition and in a twisted status. When a voltage is applied, the liquid crystal molecules are caused to stand. A long axis direction and a short axis direction of the liquid crystal molecules are different in refractive index. Therefore, when the liquid crystal molecules are in the lying condition, the liquid crystal has anisotropy of refractive index in a light propagation plane, but when the liquid crystal molecules are in the standing condition, the liquid crystal is isotropic in refractive index. Accordingly, the amount of rotation of a polarized light varies upon a voltage applied to the liquid crystal. This amount of rotation of the polarized light is defined as a product (retardation) of a refractive index anisotropy ([long axis direction refractive index] minus (short axis direction refractive index]) and a gap of the liquid cell.

If the liquid crystal is oriented as shown in FIG. 1A, the liquid crystal molecules are twisted as shown in FIG. 1B, and, therefore, anisotropy appears in the retardation. The liquid crystal molecules are oriented in a condition near to symmetry, in a left-right direction (a horizontal direction in FIG. 1B), and therefore, a viewing field angle is relatively wide, as shown in FIG. 1C. In a up-down direction (a vertical direction in FIG. 1B), however, the liquid crystal molecules are oriented in remarkable asymmetry, and therefore, the viewing field angle is narrow. Looking from the upper side, the liquid crystal molecules are seen to be in the lying condition, and looking from the lower side, the liquid crystal molecules are seen to be in the standing condition. As a result, a black level becomes remarkable in the upper viewing field, and a grayscale level inversion becomes a problem in the lower viewing field. This is a large problem in full color products in which a halftone is frequently displayed.

To realize a wide viewing angle, several approaches have been proposed. A first approach is a so called "halftone grayscale method" or "divided pixel method" which was proposed by Honeywell (SID '89 DIGEST, pp148, 1989) and which was reduced into practice by Hosiden Corporation (SID '91 DIGEST, pp555–557, 1991, and IDRC '91 DIGEST, pp255–256, 1991).

As shown in FIGS. 2A and 2B, each one pixel is divided into a plurality of subpixels 42, 43 and 44, and capacitors 48 and 49 are formed between the subpixels. Incidentally, Reference Numeral 41 designates a TFT (thin film transistor) and Reference Numerals 45, 46 and 47 indicate a liquid crystal capacitance of the subpixels 42, 43 and 44, respectively.

As shown in FIG. 3C, the viewing angle characteristics vary upon an applied voltage. Therefore, since different viewing angle characteristics of the subpixels 42, 43 and 44 are combined together, the viewing angle characteristics of the one pixel is improved as a whole.

However, this approach needs to perform a pixel forming process a plurality of times, in order to form a plurality of subpixels and a plurality of capacitors. Accordingly, a TFT manufacturing processing inevitably becomes complicated, and a production yield drops.

Another approach is a generally called "divided orientation method" which was proposed by Yang of IBM (IDRC '91 DIGEST, pp68–72, 1991) and which was improved by Fujitsu (SID '92 DIGEST, pp798–801, 1992) and NEC (JAPAN DISPLAY '92 DIGEST, pp591–594, 1992).

In the IBM approach, as shown in FIG. 3A, the divided orientation is realized by changing the rubbing direction in each of the TFT 52 side and the CF 51 side. In the Fujitsu approach, as shown in FIG. 3B, the divided orientation is realized by rubbing a high-pretilt oriented film and a low-pretilt oriented film in the same direction. Furthermore, in the NEC approach, the divided orientation is realized by putting a high-pretilt oriented film at the TFT 52 side and also changing the rubbing direction in each of the TFT 52 side and the CF 51 side, as shown in FIG. 3C.

However, the IBM approach is disadvantageous in that since the rubbing is carried out two times on each of the TFT side and the CF side, the manufacturing steps are greatly increased. In the Fujitsu approach, only one rubbing treatment is carried out on each surface, but since it is necessary to pattern the oriented films, the manufacturing steps are also increased. In the NEC approach, since the rubbing is carried out two times on the TFT side, the manufacturing steps are also increased. Here, it is to be noted that the rubbing processing is very delicate, and if the rubbing is defective, unevenness will be apt to occur in display. Accordingly, increase of the delicate treatment step will result in a drop of the production yield of liquid crystal display panels, similar to the divided pixel method.

Furthermore, at a boundary between adjacent domains having different orientation, light leakage (disclination line) occurs. Therefore, unless the boundary region is covered by a black matrix (a light blocking layer formed on the color filter), the contrast will drop. On the other hand, if the boundary region is covered by the black matrix, the pixel aperture ratio will drop, and, therefore, luminance will drop. Therefore, it is the present status that the divided orientation method is applied to normally black LCDs.

SUMMARY OF THE INVENTION

Accordingly, it is an object of the present invention to provide a liquid crystal display apparatus which has overcome the above mentioned defects of the conventional ones.

Another object of the present invention is to provide a liquid crystal display apparatus capable of electrically realizing a wide viewing field angle, without complicating the manufacturing process of the liquid crystal display.

The above and other objects of the present invention are achieved in accordance with the present invention by a liquid crystal display apparatus comprising a gamma conversion means receiving an input image signal and having a plurality of different gamma characteristics, and means for controlling the gamma conversion means to switch one gamma characteristics to another of the gamma conversion means at every "n" frames of the input image signal (where "n" is natural number), a liquid crystal display being driven on the basis of an output of the gamma conversion means.

The above and other objects, features and advantages of the present invention will be apparent from the following description of preferred embodiments of the invention with reference to the accompanying drawings.

DESCRIPTION OF THE PREFERRED EMBODIMENTS

Figure 1A:
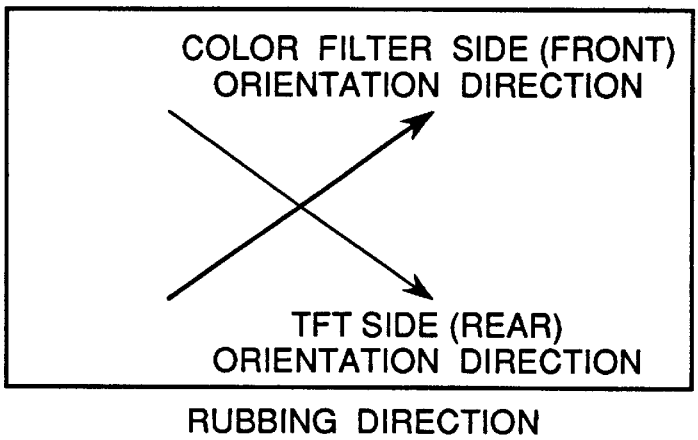
FIGURE 1A PRIOR ART
FIG. 1A, 1B, 1C and 1D illustrate various oriented conditions of a liquid crystal.
Figure 1B:
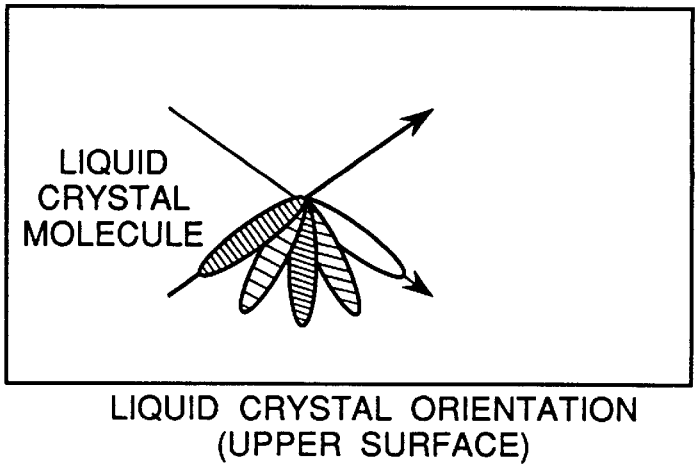
FIGURE 1B PRIOR ART
Figure 1C:
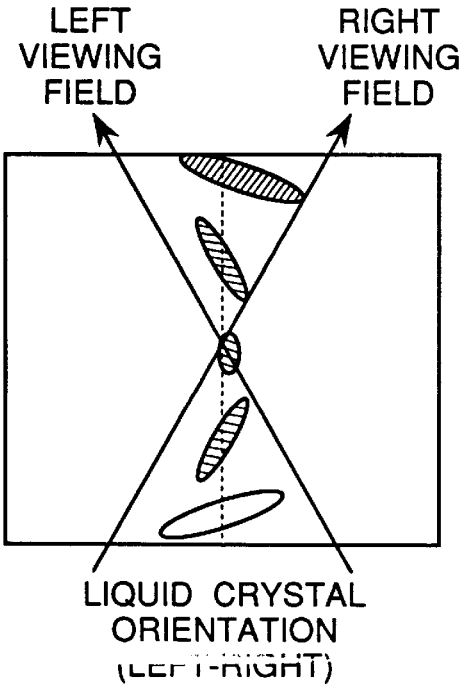
FIGURE 1C PRIOR ART
Figure 1D:
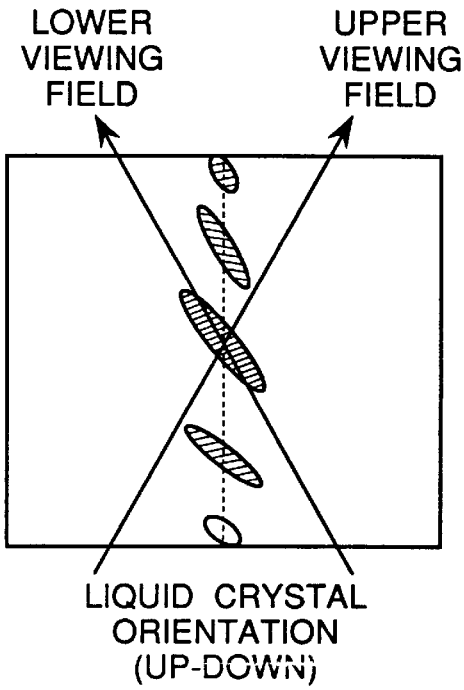
FIGURE 1D PRIOR ART
Figure 2A:
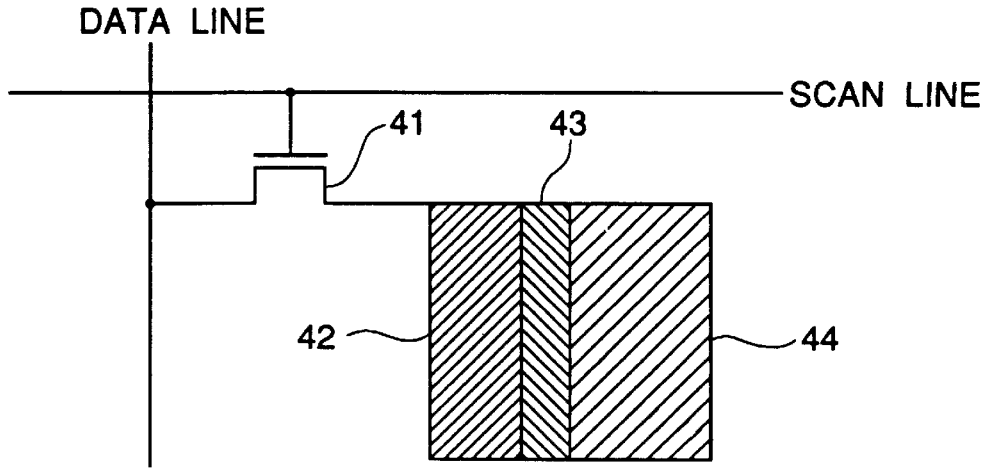
FIGURE 2A PRIOR ART
FIGS. 2A, 2B and 2C illustrate a conventional "divided pixel method"
Figure 2B:
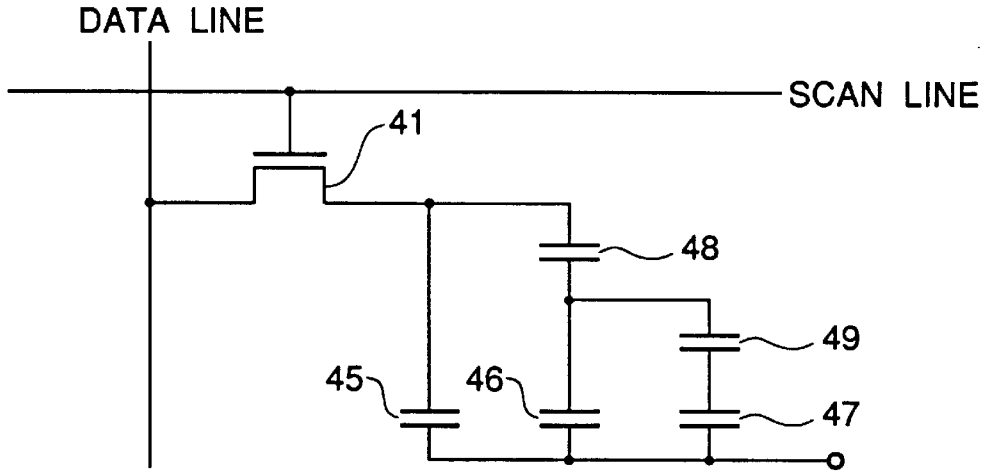
FIGURE 2B PRIOR ART
Figure 2C:
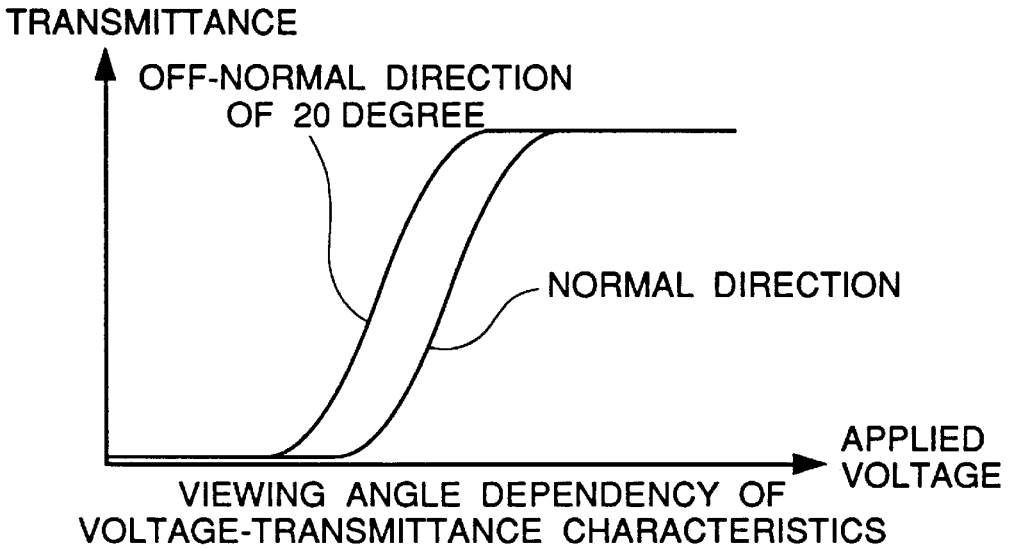
FIGURE 2C PRIOR ART
Figure 3A:
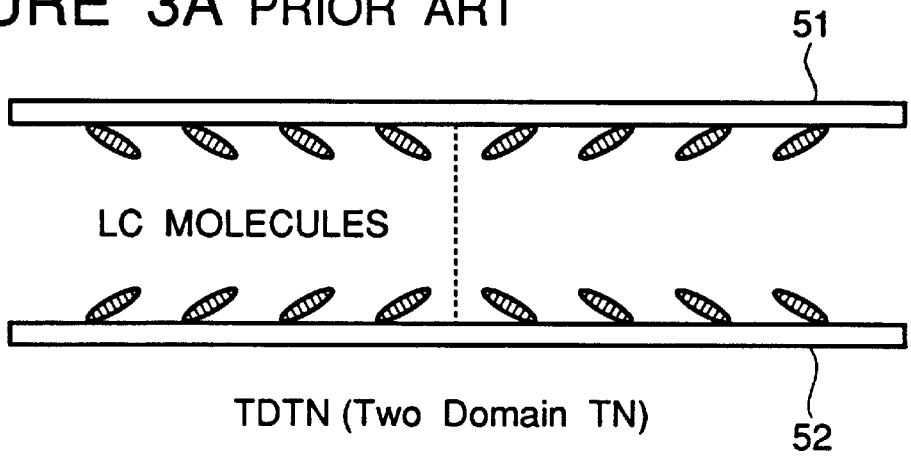
FIGURE 3A PRIOR ART
FIGS. 3A, 3B and 3C illustrate a conventional "divided orientation method"
Figure 3B:
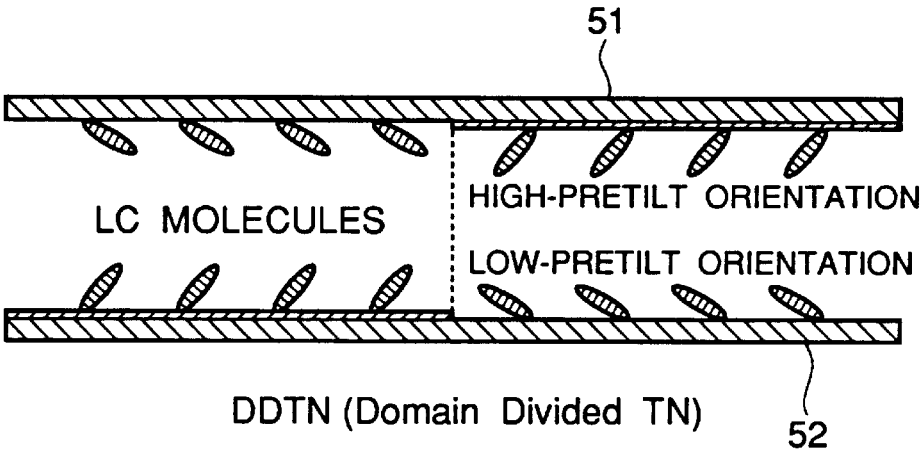
FIGURE 3B PRIOR ART
Figure 3C:
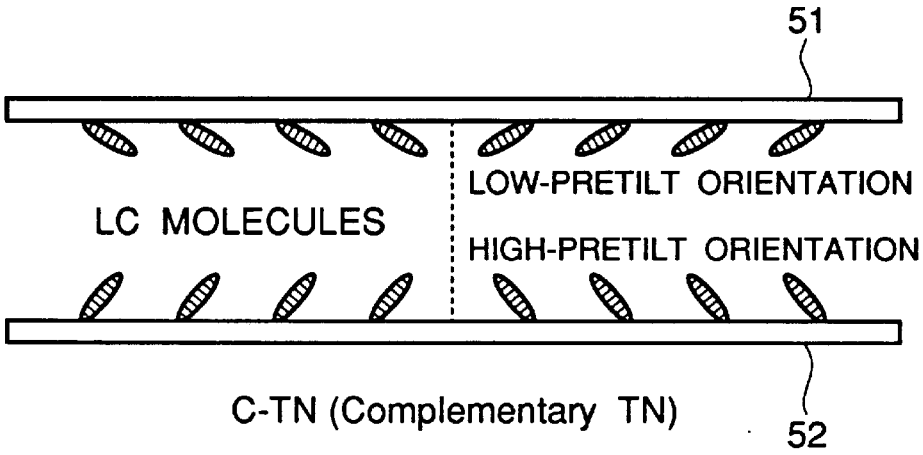
FIGURE 3C PRIOR ART
Figure 4:
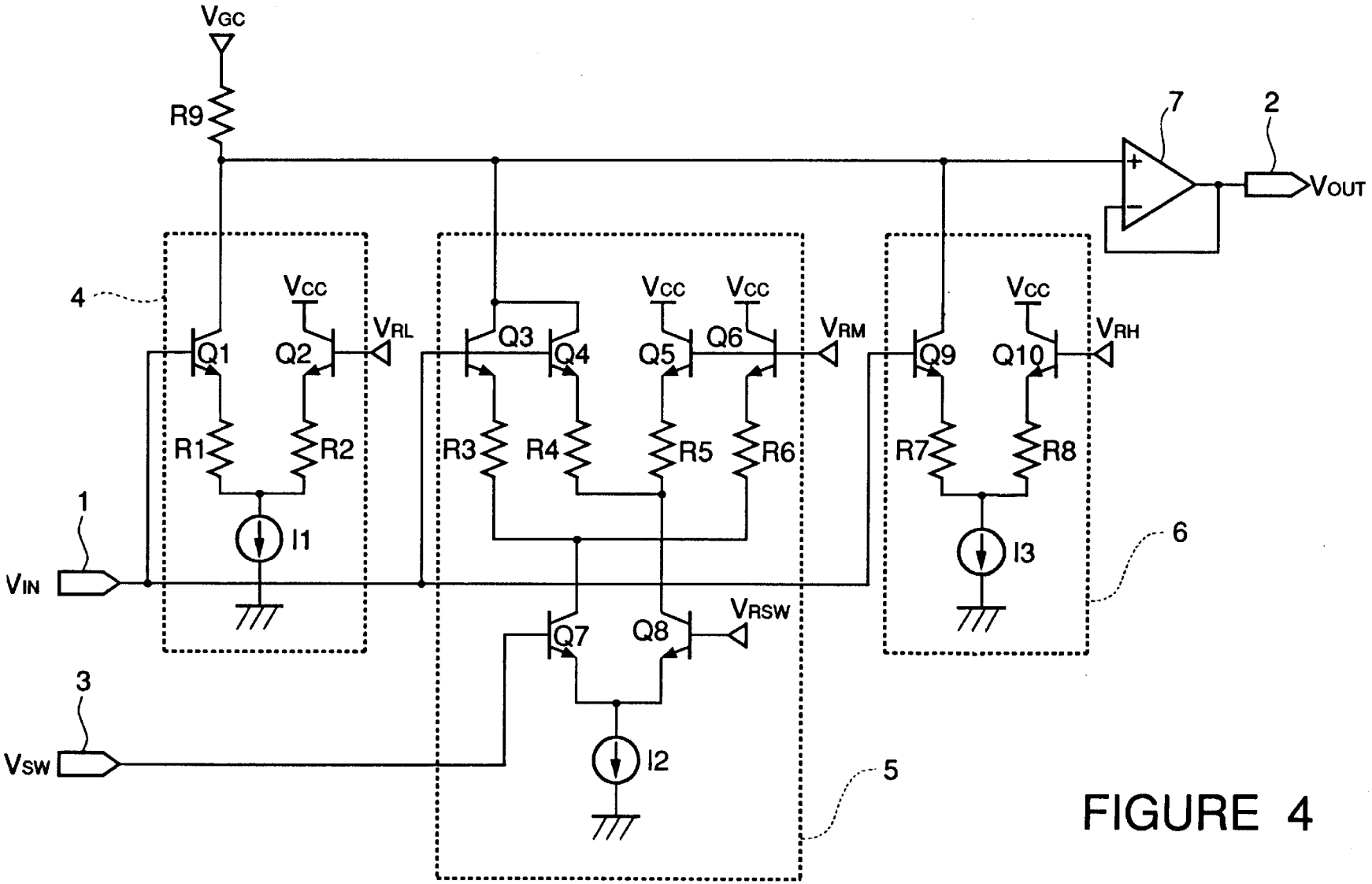
FIG. 4 is a circuit diagram of one embodiment of the gamma conversion circuit used in the liquid crystal display apparatus in accordance with the present invention.

Referring to FIG. 4, there is shown a circuit diagram of an analog gamma conversion circuit used in the liquid crystal display apparatus in accordance with the present invention. This analog gamma conversion circuit is controlled by a gamma characteristics switching signal Vsw from an external, so as to change its gamma characteristics.

The shown analog gamma conversion circuit includes three differential amplifiers 4, 5 and 6 having different gains, respectively, and an output buffer 7 having an input connected in common to outputs of the three differential amplifiers 4, 5 and 6. The outputs of the three differential amplifiers 4, 5 and 6 are connected to one end of a common load resistor R9 having the other end connected to receive a predetermined constant voltage $V_{GC}$. One input of each of the differential amplifiers 4, 5 and 6 is connected to an input terminal 1 to receive an input image signal $V_{IN}$. The other input of the differential amplifier 4 is connected to a first constant voltage $V_{RL}$ corresponding to a lowest level of the input image signal $V_{IN}$. The other input of the differential amplifier 6 is connected to a second constant voltage $V_{RH}$ corresponding to a highest level of the input image signal $V_{IN}$. The other input of the differential amplifier 5 is connected to a third constant voltage $V_{RM}$ corresponding to an intermediate level of the input image signal $V_{IN}$. An output of the output buffer 7 is connected to an output terminal 2 for supplying a voltage signal $V_{OUT}$.

More specifically, the first differential amplifier 4 includes a pair of NPN bipolar transistors Q1 and Q2 having their emitters connected through resistors R1 and R2 to one end of a constant current source I1, respectively. The other end of constant current source I1 is grounded. A base of the transistor Q1 is connected to the input terminal 1, and a collector of the transistor Q1 is connected to the one end of the common load resistor 9. A base of the transistor Q2 is connected to the lowest level voltage $V_{RL}$, and a collector of the transistor Q1 is connected to a voltage supply voltage $V_{CC}$.

Similarly, the third differential amplifier 6 includes a pair of NPN bipolar transistors Q9 and Q10 having their emitters connected through resistors R7 and R8 to one end of a constant current source I3, respectively. The other end of constant current source I3 is grounded. A base of the transistor Q9 is connected to the input terminal 1, and a collector of the transistor Q9 is connected to the one end of the common load resistor 9. A base of the transistor Q10 is connected to the highest level voltage $V_{RH}$, and a collector of the transistor Q1 is connected to the voltage supply voltage $V_{CC}$.

The second differential amplifier 5 includes two differential transistor pairs. A first transistor pair includes a pair of NPN bipolar transistors Q3 and Q6 having their emitters connected through resistors R3 and R6 to a collector of an NPN bipolar transistor Q7, respectively. A second transistor pair includes a pair of NPN bipolar transistors Q4 and Q5 having their emitters connected through resistors R4 and R5 to a collector of an NPN bipolar transistor Q8, respectively. Emitters of the transistors Q7 and Q8 are connected in common to one end of a constant current source I2, the other end of which is grounded.

A base of each of the transistors Q3 and Q4 is connected to the input terminal 1, and a collector of each of the transistors Q3 and Q4 is connected to the one end of the common load resistor 9. A base of each of the transistors Q5 and Q6 is connected to the intermediate level voltage $V_{RM}$, and a collector of each of the transistors Q5 and Q6 is connected to the voltage supply voltage $V_{CC}$. A base of the transistor Q7 is connected to a control terminal 3 so as to receive switching signal $V_{SW}$, and a base of the transistor Q8 is connected to a reference voltage $V_{RSW}$.

With this arrangement, the two differential transistor pairs can be switched from one to another by the switching signal $V_{SW}$.

Each of the differential amplifiers 4, 5 and 6 amplifies the input signal $V_{IN}$ by changing the current flowing through the common load resistor R9, in accordance with the level of the input signal $V_{IN}$. For example, a gain of the differential amplifier 4 is roughly represented by a ratio of the load resistance R9 to a sum of the emitter resistances (R1+R2). Accordingly, a desired gain can be obtained by selecting the resistances of the emitter resistors R1 to R8.

In the second differential amplifier 5, when the switching signal $V_{SW}$ is higher than the reference voltage $V_{RSW}$, the transistor Q7 is turned on and the transistor Q8 is turned off, so that the differential transistor pair Q3 and Q6 is selected. On the contrary, when the switching signal $V_{SW}$ is lower than the reference voltage $V_{RSW}$, the transistor Q7 is turned off and the transistor Q8 is turned on, so that the differential transistor pair Q4 and Q5 is selected.

Figure 5:
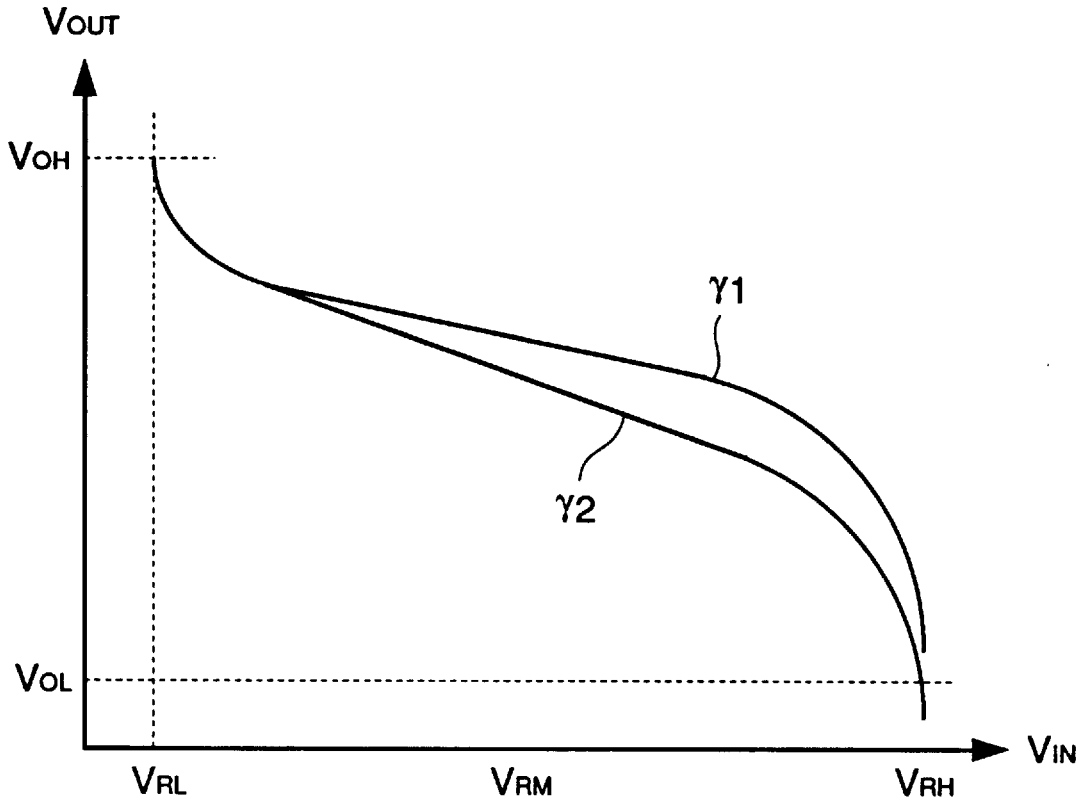
FIG. 5 is a graph showing a gamma characteristics realized in the gamma conversion circuit shown in FIG. 4.

The gain of each of the two differential transistor pairs (resistors R3 to R6), the current value of the constant current source I2, and the constant voltage $V_{GC}$ connected to the common load resistor R9 are determined so that the output voltage $V_{OUT}$ has a desired gamma characteristics. As a result, two gamma characteristics γl and γ2 as shown in FIG. 5 can be obtained. The two gamma characteristics γ1 and γ2 are set so that two different viewing field angles becomes an optimum view field.

For example, in an up-down viewing field, when the gamma value is 2.2, an optimum gradient characteristic is obtained. In an upper viewing field of 10 degrees, the optimum gradient characteristic is obtained with the gamma value=3.4. In a lower viewing field of 10 degrees, the optimum gradient characteristic is obtained with the gamma value=1.4. Accordingly, by modulating the gamma value, it is expected that the optimum gradient characteristics can be expanded to a range of ±10 degrees in the up-down direction.

Figure 6:
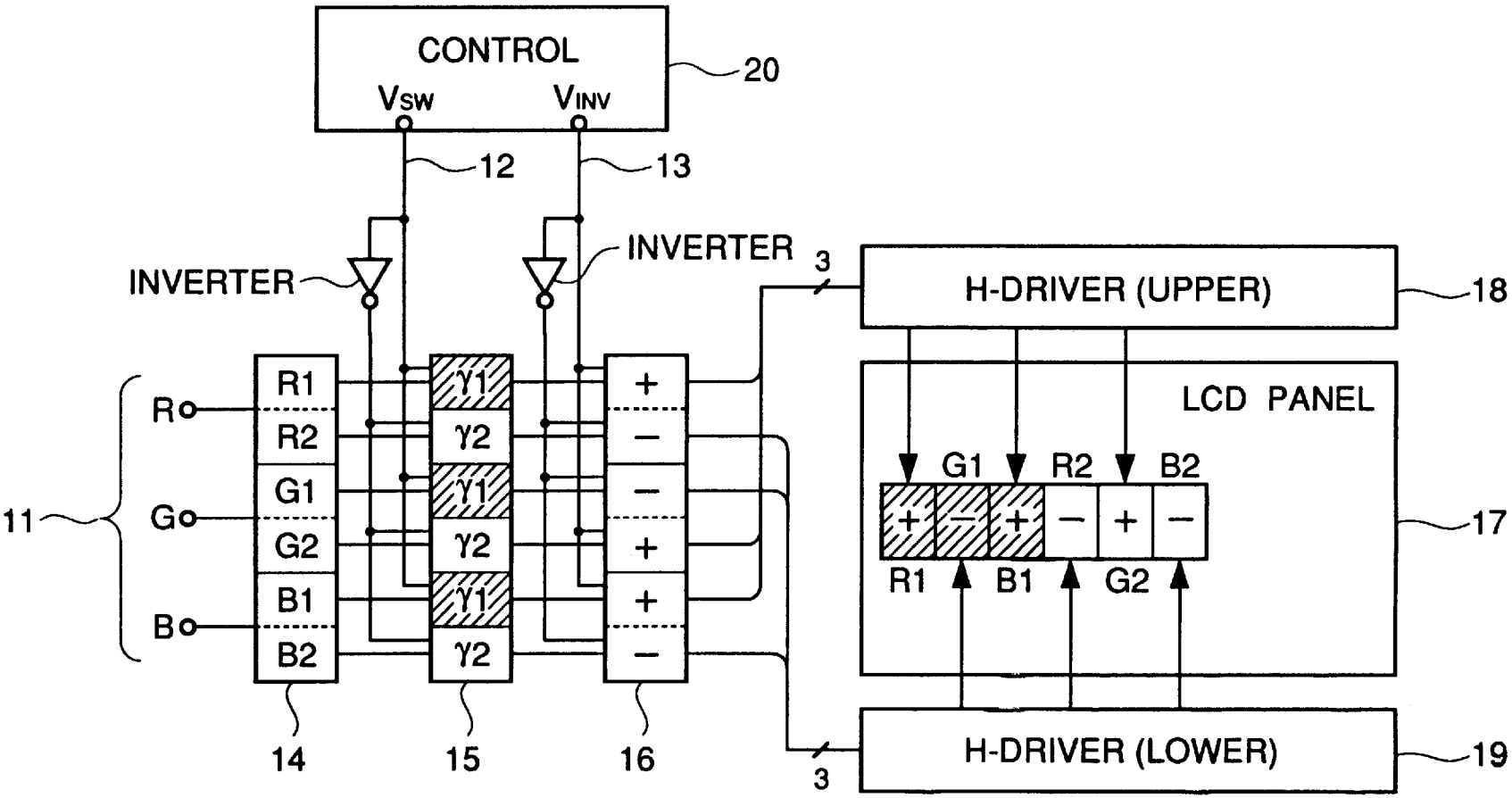
FIG. 6 is a block diagram of a first embodiment of the liquid crystal display apparatus in accordance with the present invention.

Referring to FIG. 6, there is shown a block diagram of a first embodiment of the liquid crystal display apparatus in accordance with the present invention, in which the above mentioned gamma conversion is applied to the liquid crystal display apparatus.

Three analog image signals, namely, a red signal R, a green signal G and a blue signal B are applied to a sample and hold circuit 14, in which each of the red signal R, the green signal G and the blue signal B is converted into two parallel signals. The six parallel signals are supplied to six gamma conversion circuits 15, respectively, each of which is constructed as shown in FIG. 4 and which are controlled by a gamma conversion switching signal $V_{SW}$ 12, in such a manner that each pair of adjacent gamma conversion circuits 15 respectively receive gamma conversion switching signals $V_{SW}$ opposite to each other in phase. Accordingly, continuous sample signals (continuous pixel signals) are converted by different gamma characteristics γl and γ2, The gamma converted signals outputted from the six gamma conversion circuits 15 are fed through six inverting circuits 16 to upper and lower horizontal drivers 18 and 19 associated to an LCD panel 17. The six inverting circuits 16 are controlled by an inversion control signal $V_{INV}$ so that each pair of inverting circuits 16 output voltage signals opposite to each other in polarity. In this case, the R, G and B signals corresponding to the same pixel are gamma-converted in accordance with the same gamma characteristics.

The gamma conversion switching signals $V_{SW}$ and the inversion control signal $V_{INV}$ are supplied from a control circuit 20. By this control circuit 20, the gamma conversion switching signal $V_{SW}$ is switched each one horizontal scan period, and inverted in phase each two vertical scan periods.

Furthermore, the inverting circuits 16 are controlled by the control circuit 20 through the inversion control signal $V_{INV}$, so that the voltage signals supplied to the upper H-driver 18 and the voltage signals supplied to the lower H-driver 19 are opposite to each other in polarity, and also inverted each one horizontal scan period.

Figure 7:
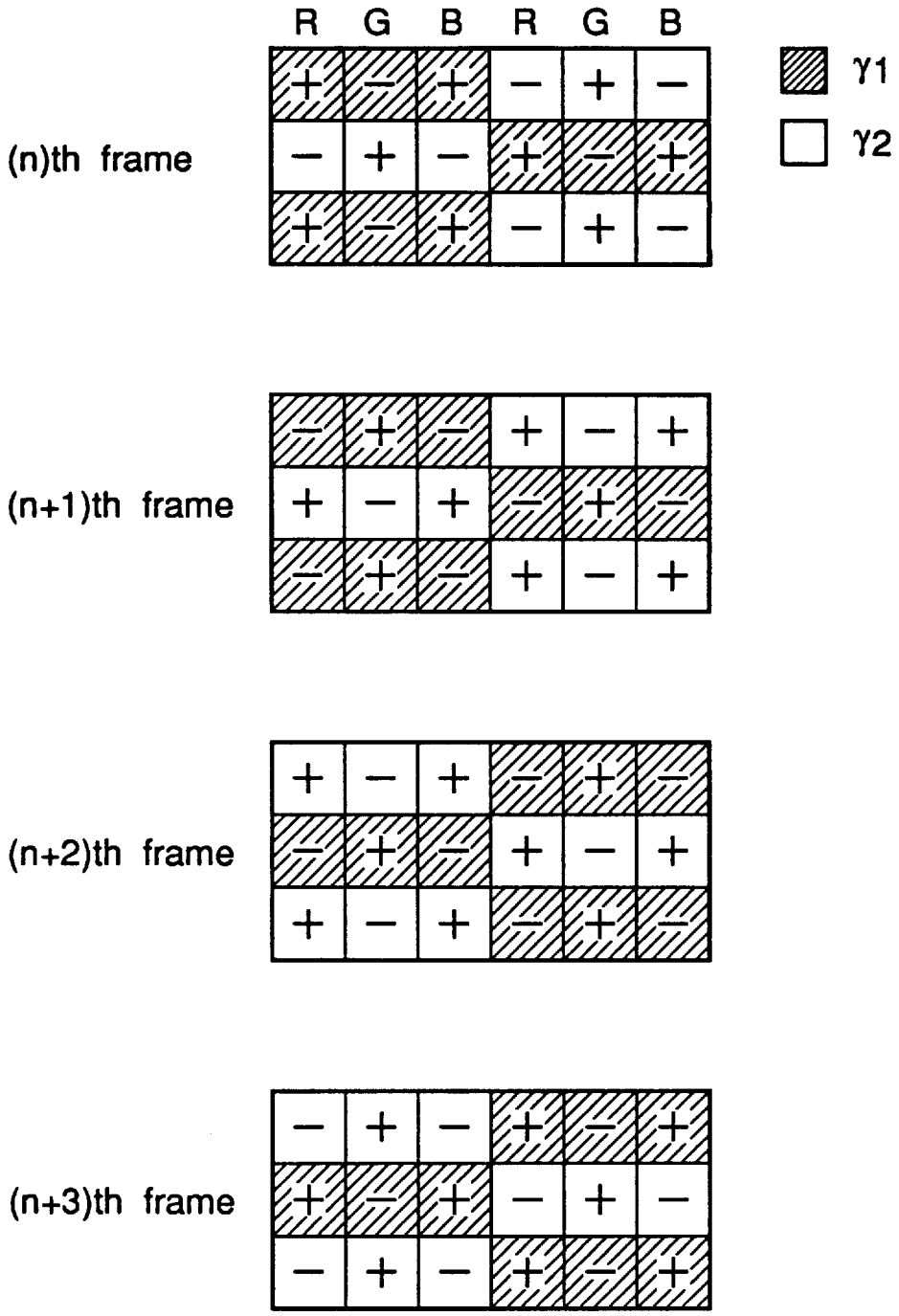
FIG. 7 illustrate one example of voltages applied to a group of adjacent pixels.

As a result, voltage signals are applied to pixel dots as shown in FIG. 7. In FIG. 7, each small block represents one pixel dot. Hatched blocks show a pixel dot applied with then voltage signal gamma-converted with the gamma value=γl, and unhatched blocks show a pixel dot applied with the voltage signal gamma-converted with the gamma value=γ2. In addition, signs "+" and "−" in the blocks, indicate a polarity of the applied voltage (namely, positive voltage and negative voltage).

As seen from FIG. 7, for the same pixel (composed of three R, G and B pixel dots continuous in a horizontal direction), signal voltages which were converted in accordance with the same gamma characteristics and which have voltage polarities opposite to each other, are applied in two continuous frames. In succeeding two frames, signal voltages which were converted in accordance with the gamma characteristics different from that used in the preceding two frames and which have voltage polarities opposite to each other, are applied.

With this arrangement, a color balance of red, green and blue is maintained. In addition, it is possible to avoid an image sticking which would otherwise occur due to a fixed polarization of the liquid crystal and the oriented films because of a residual DC voltage occurring due to unbalance of positive and negative voltages when the voltages obtained in accordance with different gamma characteristics are continuously applied.

In the above mentioned embodiment, the gamma characteristic is switched each "n" frames (n=2). However, the gamma characteristics may be switched each one frame or each three frames. But, if "n" is too large, flicker occurs. Therefore, "n"=1 to 4 is optimum.

Figure 8:
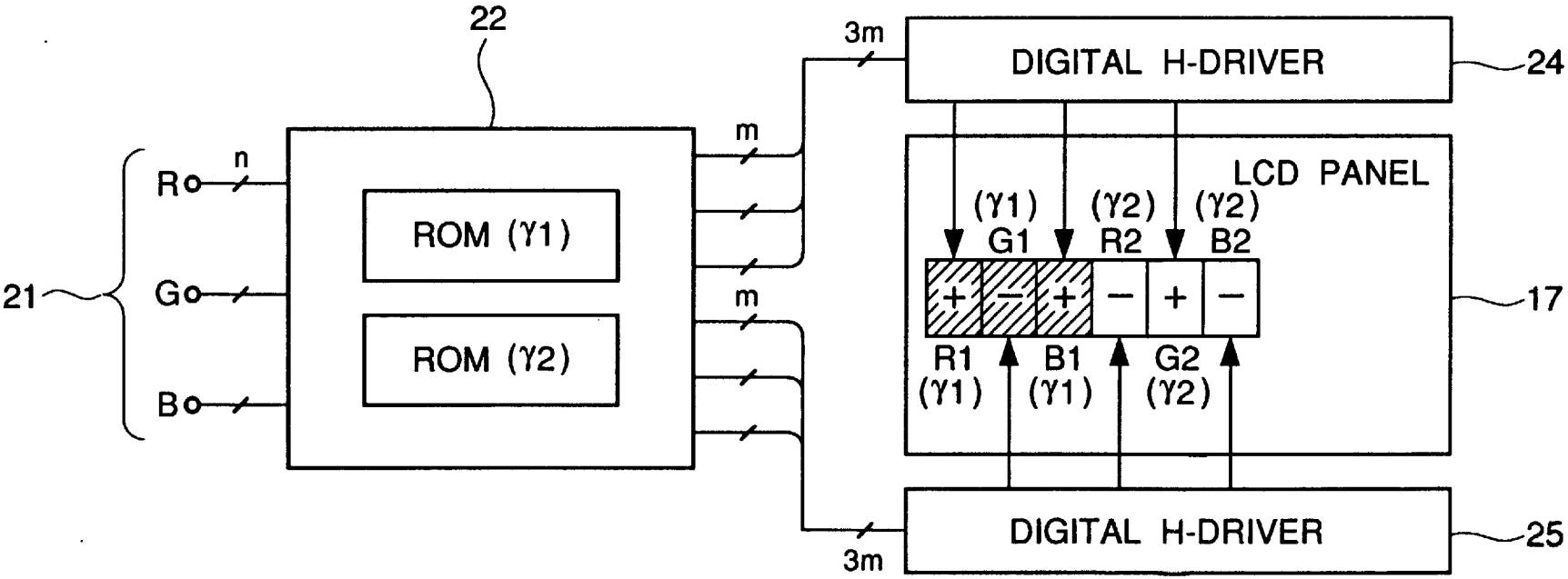
FIG. 8 is a block diagram of a second embodiment, of the liquid crystal display apparatus in accordance with the present invention.

Referring to FIG. 8, there is shown a block diagram of a second embodiment of the liquid crystal display apparatus in accordance with the present invention.

The second embodiment is of a digital type, and has a gamma conversion circuit 22 containing a plurality of memories for realizing a plurality of gamma characteristics. A digital image signal 21 (digital R, G and B signals) is supplied to the gamma conversion circuit 22, which includes two read only memories ROM(γl) and ROM(γ2) having different gamma conversion tables, respectively. Similarly to the first embodiment, the signals for the pixel dots in the same pixel are gamma-converted by using the same gamma conversion table (namely, the same ROM), and the signals for the pixel dots in an adjacent pixel are gamma-converted by using a different gamma conversion table (namely, a different ROM). Gamma-converted signals outputted from the gamma conversion circuit 22 are distributed to upper and lower digital horizontal drivers 24 and 25, respectively, which drive the LCD panel 17.

By changing the gamma conversion table each two frames, the voltage signals are supplied to the respective pixel dots, as shown in FIG. 7.

Figure 9:
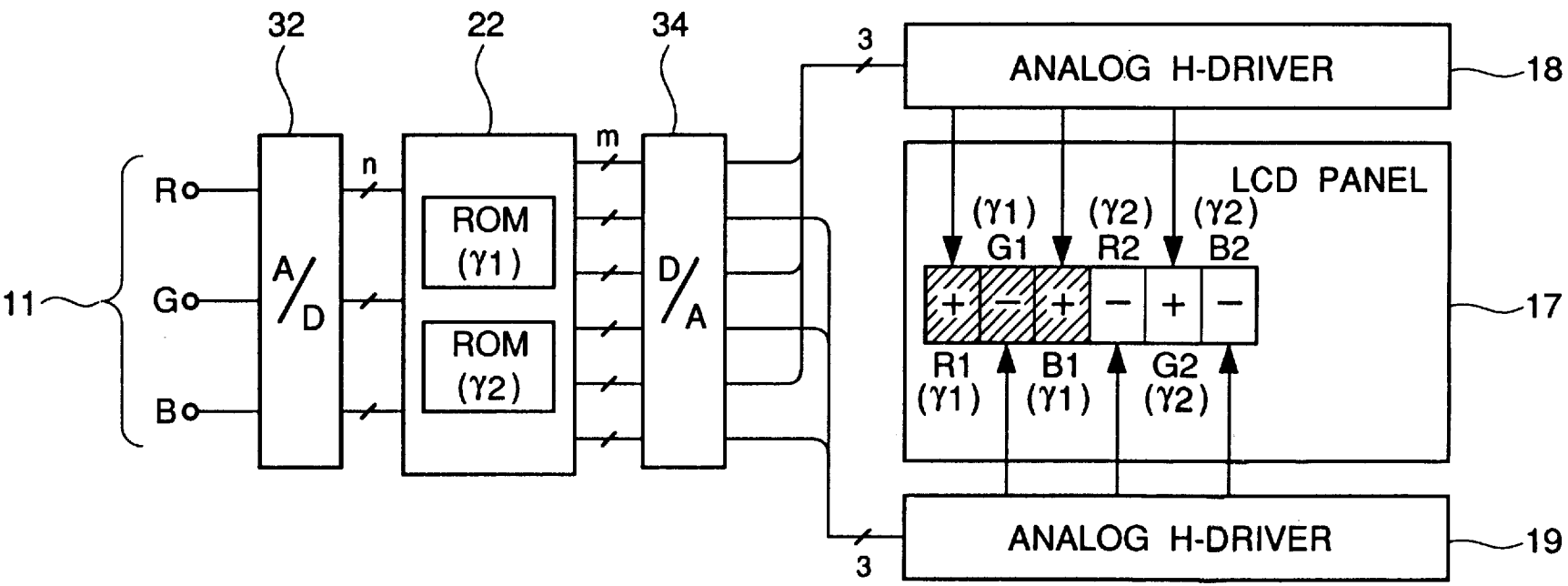
FIG. 9 is a block diagram of a third embodiment of the liquid crystal display apparatus in accordance with the present invention.

Referring to FIG. 9, there is shown a block diagram of a modification of the second embodiment which is modified to receive the analog image signal 11 and to drive the analog H-drivers 18 and 19.

For this purpose, the analog R, G and G signals 11 are converted by an analog-to-digital (A/D) converter 32 to digital signals, which are supplied to the gamma conversion circuit 22. Gamma-converted signals outputted from the gamma conversion circuit 22 are converted by a digital-to-analog (D/A) converter 34 to analog voltage signals, which are supplied to the analog H-drivers 18 and 19, respectively.

In the above mentioned embodiment, the frame modulation is made with only the two gamma characteristics. However, it is possible to use three or more gamma characteristics in order to further expand the viewing field angle.

Figure 10A:
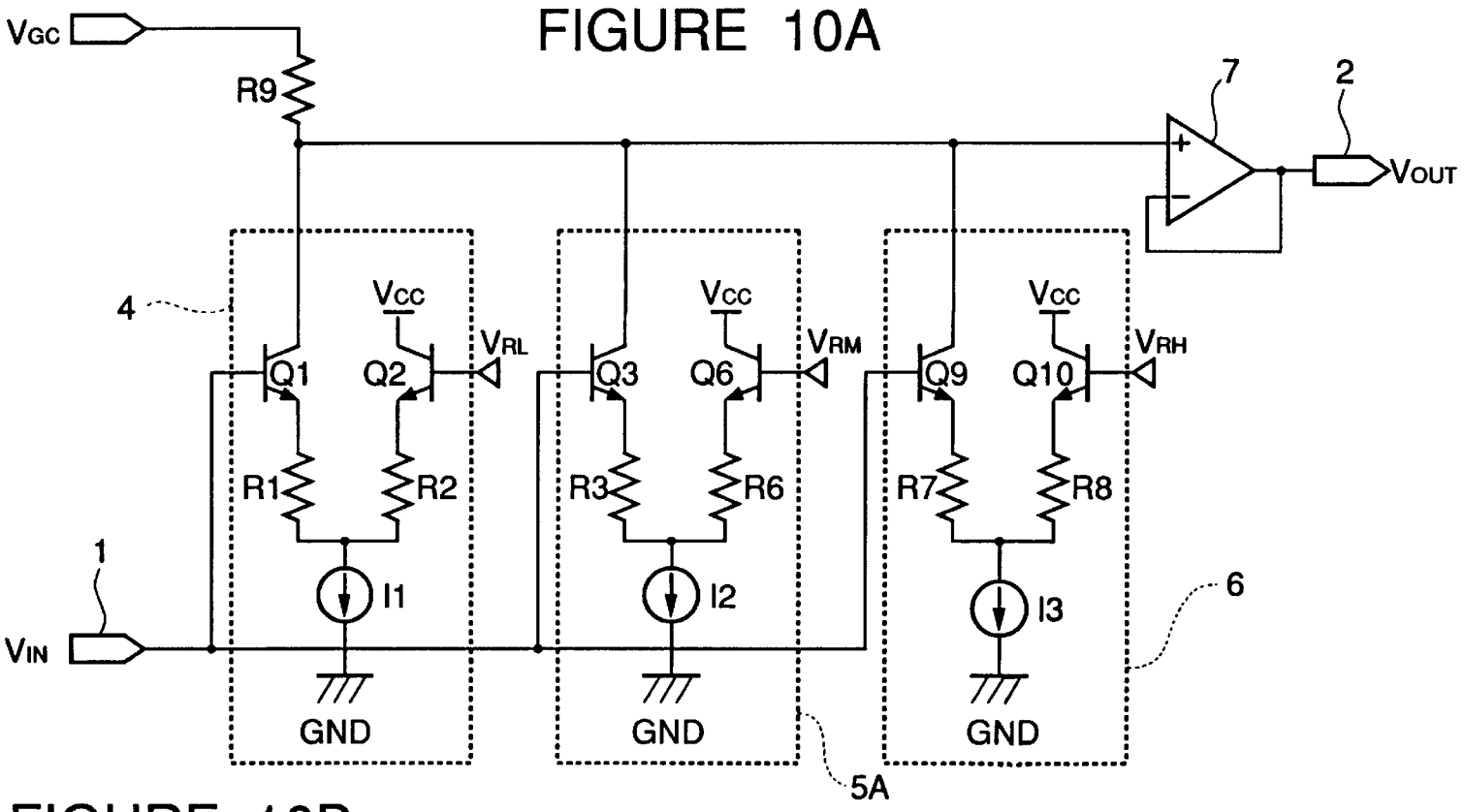
FIG. 10A is a circuit diagram of another embodiment of the gamma conversion circuit used in the liquid crystal display apparatus in accordance with the present invention.

Referring to FIG. 10A, there is shown a circuit diagram of another embodiment of the gamma conversion circuit used in the liquid crystal display apparatus in accordance with the present invention. In FIG. 10A, elements similar to those shown in FIG. 4 are given the same Reference Numerals, and explanation thereof will be omitted for simplification of description.

Figure 10B:
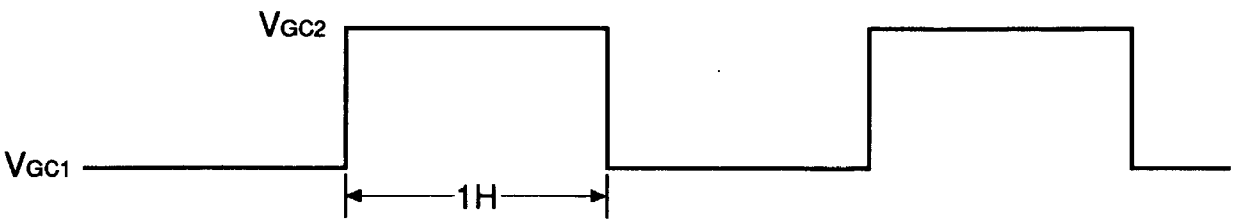
FIG. 10B is a waveform diagram illustrating a gamma conversion control signal applied to the gamma conversion circuit shown in FIG. 10A.
Figure 11:
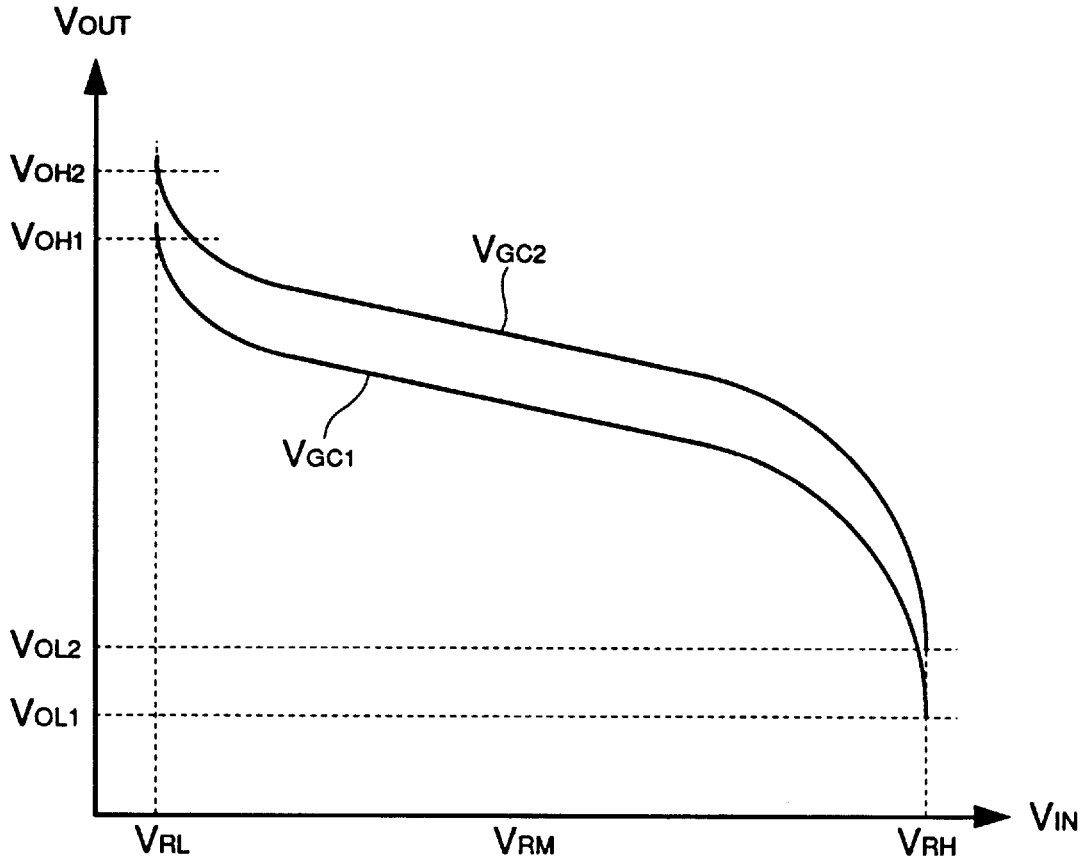
FIG. 11 is a graph showing a gamma characteristics realized in the gamma conversion circuit shown in FIG. 10A.

In the second embodiment of the gamma conversion circuit, the gamma characteristic is changed, not by changing the gamma value, but by shifting the voltage level applied to the common load resistor. Namely, in place of the constant voltage $V_{GC}$ applied to the common load resistor R9 in FIG. 4, two voltage levels $V_{GC1}$ and $V_{GC2}$ are alternately applied to the common load resistor R9, one during one horizontal scan period, as shown in FIG. 10B. As a result, two gamma conversion characteristics as shown in FIG. 11 can be obtained.

In the embodiment shown in FIG. 4, since the gamma value is modified, it is possible to improve the viewing field angle dependency of the grayscale characteristics, but it is difficult to greatly elevate the contrast ratio of the white and black luminance. In the embodiment shown in FIG. 10A, the voltage $V_{GC}$ is shifted by for example 0.5 V, the viewing field angle having the contrast ratio of 10 can be expanded from the current range of ±10 degrees in the up-down direction, to ±20 degrees in the up-down direction.

As mentioned above, the liquid crystal display apparatus in accordance with the present invention can increase the viewing field angle, by modulating the image signals in space and in time, by supplying to each pixel the signal voltages obtained in accordance with the different gamma characteristics, each frame or each plural frames. Accordingly, the viewing field angle can be increased without complicating the TFT manufacturing process or the panel manufacturing process, and without increasing the necessary manufacturing steps.

For example, if the image signals are modulated with the gamma value=1.4 and the gamma value=3.4, the up-down viewing field angle allowing the optimum gradient can be improved by about 10 degrees. In addition, if the gamma characteristic is modulated by the voltage signals level-shifted by about 0.5 V, the viewing field angle having the same contrast ratio can be improved by about 20 degrees.

The invention has thus been shown and described with reference to the specific embodiments. However, it should be noted that the present invention is in no way limited to the details of the illustrated structures but changes and modifications may be made within the scope of the appended claims.

We claim:

1. A liquid crystal display apparatus, comprising:

only one liquid crystal display, gamma conversion means providing gamma converted signals based on an input image signal, each of said gamma converted signals having a respective selected one of a plurality of different gamma characteristics, said plurality of different gamma characteristics including a γ1 characteristic and a γ2 characteristic different from said γ1 characteristic, and means for controlling said gamma conversion means to switch said selected one of said plurality of different gamma characteristics to another of said plurality of different gamma characteristics at each "n" frames of said input image signal (where "n" is natural number);

wherein said only one liquid crystal display is driven on the basis of said gamma converted signals.

2. A liquid crystal display apparatus as claimed in claim 1, wherein:

said input image signal comprises pixels; and said apparatus further comprises means for controlling said gamma conversion means to switch said selected one of said plurality of different gamma characteristics to said another of said plurality of different gamma characteristics at each pixel of said input image signal.

3. A liquid crystal display apparatus as claimed in claim 2, wherein:

said apparatus further comprises means for controlling said gamma conversion means to apply, for each of said gamma converted signals, corresponding display signal voltages having opposite polarity; and each of said corresponding display signal voltages are applied to a corresponding pixel of said only one liquid crystal display in continuous "n" frames.

4. A liquid crystal display apparatus as claimed in claim 3, wherein said gamma conversion means includes:

differential amplifier means receiving said input image signal, and gain control means for controlling a gain of said differential amplifier means on the basis of a gamma characteristics switchover signal.

5. A liquid crystal display apparatus as claimed in claim 4, wherein said gamma conversion means, in response to said gamma characteristics switchover signal, changes an operating voltage applied to a load impedance element in said differential amplifier means.

6. A liquid crystal display apparatus as claimed in claim 3, wherein:

said gamma conversion means includes a plurality of storing means;

each of said plurality of storing means stores respective output signal information which corresponds to said input image signal, and which is in accordance with a corresponding one of said plurality of different gamma characteristics, and said output information is selected on the basis of a gamma characteristics switchover signal.

7. A liquid crystal display apparatus as claimed in claim 1, wherein:

said apparatus further comprises means for controlling said gamma conversion means to apply, for each of said gamma converted signals, corresponding display signal voltages having opposite polarity; and each of said corresponding display signal voltages are applied to a corresponding pixel of said only one liquid crystal display in continuous "n" frames.

8. A liquid crystal display apparatus as claimed in claim 7, wherein said gamma conversion means includes:

differential amplifier means receiving said input image signal, and gain control means for controlling a gain of said differential amplifier means on the basis of a gamma characteristics switchover signal.

9. A liquid crystal display apparatus as claimed in claim 8, wherein said gamma conversion means, in response to said gamma characteristics switchover signal, changes an operating voltage applied to a load impedance element in said differential amplifier means.

10. A liquid crystal display apparatus as claimed in claim 7, wherein:

said gamma conversion means includes a plurality of storing means;

each of said plurality of storing means stores respective output signal information which corresponds to said input image signal, and which is in accordance with a corresponding one of said plurality of different gamma characteristics, and said output information is selected on the basis of a gamma characteristics switchover signal.

11. A liquid crystal display apparatus as claimed in claim 1, wherein said gamma conversion means includes:

differential amplifier means receiving said input image signal, and gain control means for controlling a gain of said differential amplifier means on the basis of a gamma characteristics switchover signal.

12. A liquid crystal display apparatus as claimed in claim 11, wherein said gamma conversion means, in response to said gamma characteristics switchover signal, changes an operating voltage applied to a load impedance element in said differential amplifier means.

13. A liquid crystal display apparatus as claimed in claim 1, wherein:

said gamma conversion means includes a plurality of storing means;

each of said plurality of storing means stores respective output signal information which corresponds to said input image signal, and which is in accordance with a corresponding one of said plurality of different gamma characteristics, and said output information is selected on the basis of a gamma characteristics switchover signal.

* * * * *